US009657414B2

(12) United States Patent
Schroeder et al.

(10) Patent No.: US 9,657,414 B2
(45) Date of Patent: May 23, 2017

(54) METHOD AND DEVICE FOR OPERATING A DRAWING LINE OR DRAWING UNIT

(71) Applicant: Fleissner GmbH, Egelsbach (DE)

(72) Inventors: Rolf Schroeder, Langen (DE); Michael Breidert, Erzhausen (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 14/464,303

(22) Filed: Aug. 20, 2014

(65) Prior Publication Data

US 2014/0353866 A1 Dec. 4, 2014

Related U.S. Application Data

(60) Division of application No. 12/625,032, filed on Nov. 24, 2009, now abandoned, and a continuation of application No. PCT/DE2008/000663, filed on Apr. 15, 2008.

(30) Foreign Application Priority Data

May 24, 2007 (DE) ..... 10 2007 024 350

(51) Int. Cl.

| | |
|---|---|
| ***D01G 1/06*** | (2006.01) |
| ***D01G 1/08*** | (2006.01) |
| ***D01H 5/22*** | (2006.01) |
| ***D01H 5/30*** | (2006.01) |
| ***D02J 1/22*** | (2006.01) |
| ***D02J 13/00*** | (2006.01) |

(52) U.S. Cl.

CPC ..... *D01G 1/06* (2013.01); *D01G 1/08* (2013.01); *D01H 5/22* (2013.01); *D01H 5/30* (2013.01); *D02J 1/22* (2013.01); *D02J 13/005* (2013.01)

(58) Field of Classification Search

CPC ..... D01G 1/08
USPC ..... 264/40.7; 425/145
See application file for complete search history.

(56) References Cited

U.S. PATENT DOCUMENTS

| | | | |
|---|---|---|---|
| 4,069,985 | A | 1/1978 | Lohest et al. |
| 6,017,398 | A | 1/2000 | Scotto et al. |
| 2007/0170150 | A1 | 7/2007 | Bostanjoglo et al. |

FOREIGN PATENT DOCUMENTS

| | | | |
|---|---|---|---|
| DE | 41 26 392 | C1 | 12/1992 |
| DE | 1111 901 | B | 6/2002 |
| EP | 2 148 619 | A1 | 4/1973 |
| EP | 0 392 194 | A1 | 10/1990 |
| EP | 1 522 613 | A1 | 4/2005 |
| EP | 1 559 485 | A1 | 8/2005 |
| FR | 2 755 038 | | 4/1998 |

(Continued)

OTHER PUBLICATIONS

"Braided Line Precautions," Avetreels, http://avetreels.net/BRAIDED_LINE_PRECAUTIONS.php, pp. 1-3, (retrieved Jun. 27, 2013).

(Continued)

*Primary Examiner* — Timothy Kennedy
(74) *Attorney, Agent, or Firm* — Muncy, Geissler, Olds & Lowe, P.C.

(57) ABSTRACT

A method and device for operating a drawing line or drawing unit for drawing cables from polymer threads using a plurality of driven drawing rollers. According to the invention, each drawing roller is controlled to a prescribed motion value. To this end, each drawing roller is associated with a separately controllable drive device.

15 Claims, 4 Drawing Sheets

(56) References Cited

FOREIGN PATENT DOCUMENTS

| | | | |
|---|---|---|---|
| WO | WO 97/38803 | A1 | 10/1997 |
| WO | WO 02/45887 | A1 | 6/2002 |
| WO | WO 2004/054699 | A2 | 7/2004 |

OTHER PUBLICATIONS

Wikipedia, "Induction Motor," http://en.wikipedia.org/wiki/induction_motor, pp. 1-7 (retrieved Oct. 5, 2011).

METHOD AND DEVICE FOR OPERATING A DRAWING LINE OR DRAWING UNIT

This nonprovisional is a divisional application of U.S. application Ser. No. 12/625,032, which is a continuation of International Application No. PCT/DE2008/000663, which was filed on Apr. 15, 2008, and which claims priority to German Patent Application No. 10 2007 024 350.4, which was filed in Germany on May 24, 2007, and which are both herein incorporated by reference.

BACKGROUND OF THE INVENTION

Field of the Invention

The invention relates to a method and a device for operating a drawing line or drawing unit.

Description of the Background Art

DE 21 48 619, which is incorporated herein by reference, illustrates a device for drawing of tows having high polymer synthetic filaments in drawing units with intake units and drawing units where the tow mass is divided into several individual tows.

SUMMARY OF THE INVENTION

It is an object of the present invention to provide a method and a device for driving a drawing unit in line.

In an embodiment, each drawing roller can be driven by a separate drive unit that can be controlled by an actuator to operate at a specified speed or with the torque required for driving the relevant drawing roller. Different speeds (rotational speeds) of two drawing units allow the tows or filaments passing round the drawing rollers to be drawn by a certain amount. The accumulated speed ratio from the first intake drawing roller to the last discharge drawing roller can range, for example, from 1:3 to 1:4. Since the individual drawing rollers or godets are not driven centrally by one drive unit, but each godet instead is driven individually, the drawing unit can be operated more precisely. It is also an advantage that the drives within one drawing unit are nearly identical and that the load can be distributed evenly. Slip can be considerably reduced by the individual drives.

In an embodiment, the required torque of the drive unit can be set or the drives of the individual godets can be operated through a control unit.

In another embodiment, the motors can be designed as asynchronous drives and the control unit can contain a frequency converter including a tacho-generator connectable to the motor. The frequency converter can be used to set the required rotational speed and thus also the torque of one godet each. The frequency converter allows the required optimum speed to be adjusted for each individual motor. For more complex control requirements, field-oriented converters can be used. These can include a speed controller based on a secondary current controller. The motor characteristics are saved or possibly even automatically determined and adapted in an electronic motor model stored in the converter. This offers the advantage that there has to be no separate speed measurement and feedback for controlling speed and torque. The only feedback used for control is the instantaneous current. Based on current level and phase relation to voltage, all required motor conditions (speed, slip, torque and even heat loss) can be established.

If a disturbance occurs, such as tow rupture during drawing, this disturbance is also registered by a speed sensor and/or by means of the frequency converter, a fault signal is generated and the line can immediately be switched off automatically. For this purpose, the speed and/or the torque of each motor is registered and compared to a given value which can exclusively occur in the event of fault (sudden speed increase). These values are established and saved. By specific adjustment of speeds the respective motors can be designed in an optimum manner, the motor rating can be fully used and costs can consequently be reduced. Moreover, the range of applications of such a line will expand and frequent malfunctions will be avoided.

It is also an advantage that the frequency converter assigned to a motor compares the actual torque with the setpoint torque and then adapts the drive speed of the appertaining motor.

It is beneficial that the surfaces of the godets are chromium-plated or provided with ceramic coating in order to generate higher adhesion.

In an embodiment, the first godet can be driven at a fixed speed which is not changed by the open-loop or closed-loop control system; the speed of the last godet is also fixed, thus determining the drawing ratio. The line is started according to the dotted line (FIG. 7) with a freely selectable starting draw ratio, while the speed increase is distributed among the individual godets either in a linear or freely selectable manner. The tow can be placed on the godets and speed optimization is started. The drives of the individual godets are constantly monitored by means of frequency converters and the actual torque is compared with the calculated average setpoint torque, the speed is thus controlled accordingly while the line is accelerated to maximum speed. Also, the speeds can be saved in a setpoint curve and can be used during the next starting procedure to quicken the starting cycle.

It is also an advantage that optimum drive adjustment of all motors or setting of the desired driving torque for each motor is done automatically through gradual approximation or iteration toward a setpoint torque curve or setpoint torque characteristic.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
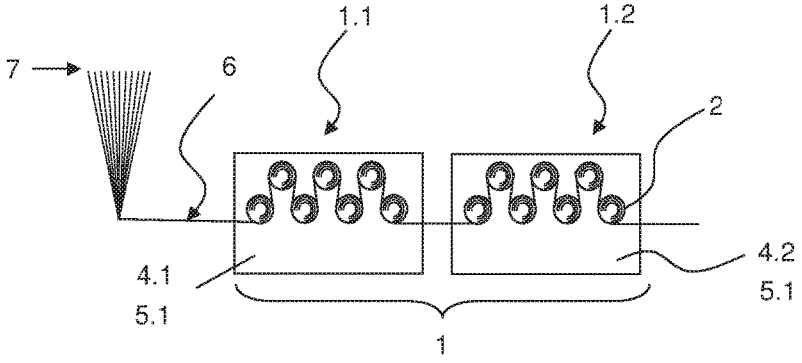
FIG. 1 is a schematic representation of a drawing line with two drawing units.
Figure 2:
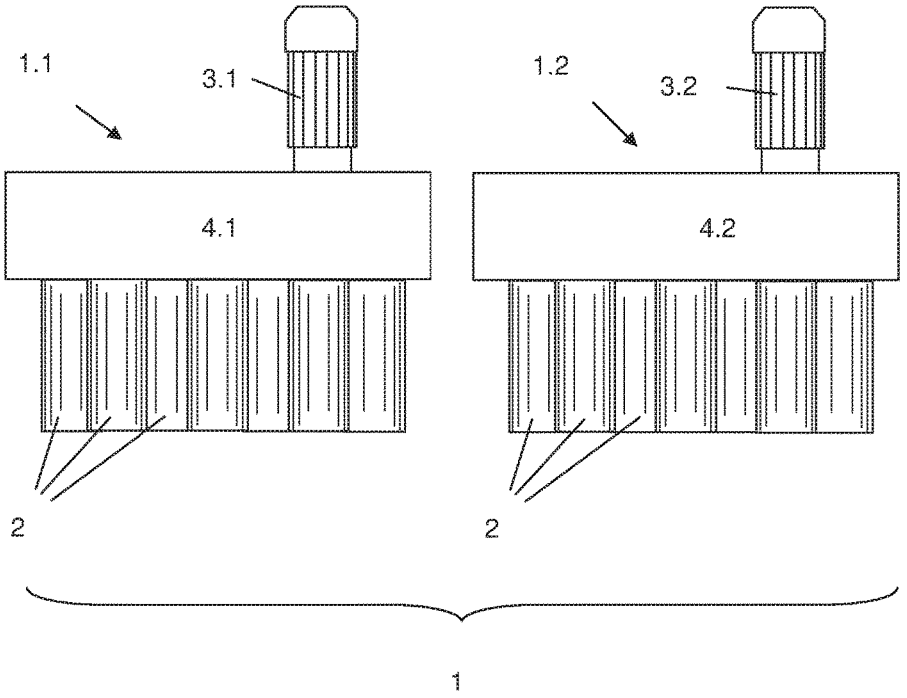
FIG. 2 is a top view of the drawing line with two drawing units and one joint drive each.

FIG. 1 shows a layout of a drawing line 1 known as such with drawing rollers or godets 2 which are arranged in two drawing units 1.1, 1.2. The two drawing units 1.1 and 1.2 contain arrangements of seven godets 2 each. In a drawing line 1 to the state of the art, as illustrated in FIG. 2, the godets 2 of drawing units 1.1 and 1.2 are driven by a central driving unit or through one assigned motor 3.1, 3.2 each and a gearbox symbolized in the respective frame 4.1, 4.2.

Figure 3:
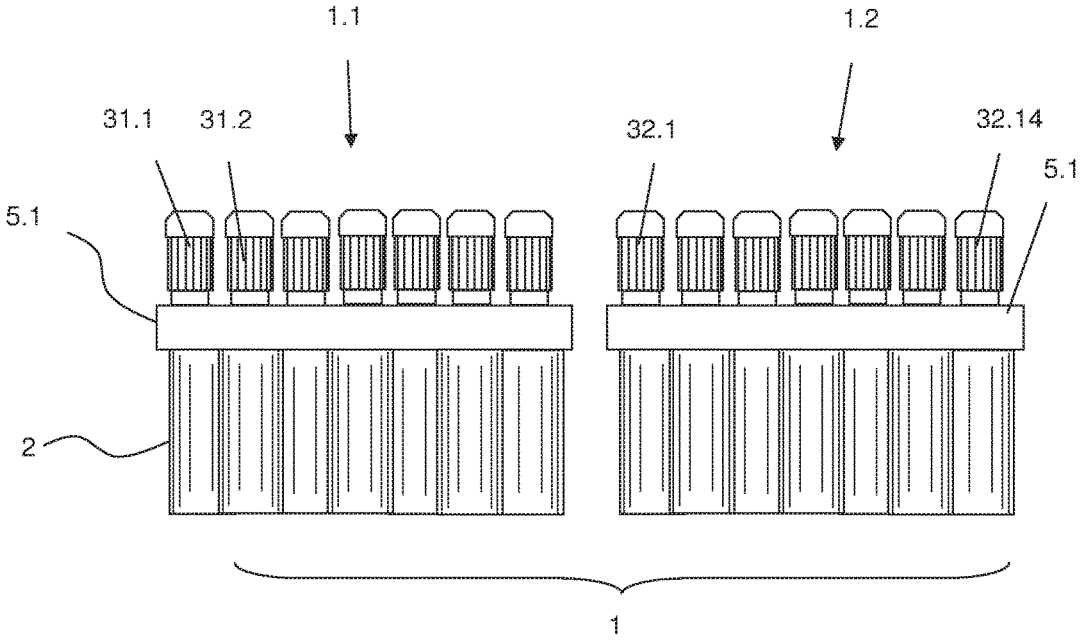
FIG. 3 is a schematic representation as a top view of an individual motor arrangement for individually and separately driving the godets of a drawing unit.

FIG. 3 shows the drawing line 1 according to the invention with a total of fourteen godets 2. The drawing line 1 according to this embodiment includes a first drawing unit 1.1 and a second drawing unit 1.2.

According to FIG. 3, individual motors 31.1, 31.2, . . . 32.14 are mounted in the drawing units 1.1, 1.2 in one support 5.1, 5.2 each, which also contain the bearings for rotation of the godets 2. The supports 5.1, 5.2 are shown only schematically. The sheet with FIG. 3 and the sheet with FIG. 2 both show the overall layout of drawing line 1 as FIG. 1 so that the assignment of drives 31.1, 31.2, . . . 32.14 to the fourteen godets in all of the two drawing units 1.1, 1.2 becomes clear.

Each motor 31.1, 31.2, . . . 32.14, which can be designed as a water-cooled motor, is used for direct drive of an individual godet 2. Inserted between the drive shaft of the motor 3 and the drive shaft of the godet 2 is a joint, a joint shaft or a self-aligning bearing so that lateral offset or effects caused by bending moments can be compensated.

Figure 4:
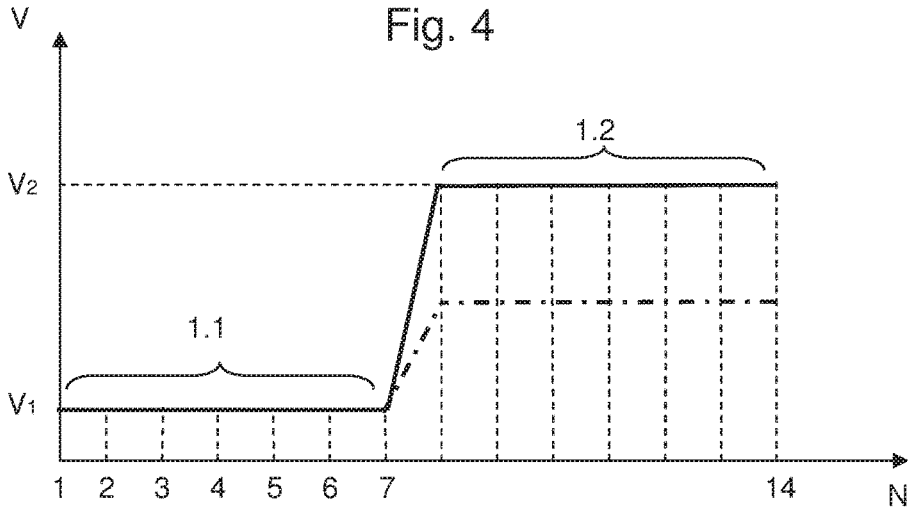
FIG. 4 is a process speed diagram of the godets in a drawing line with two drawing units according to FIG. 2.
Figure 5:
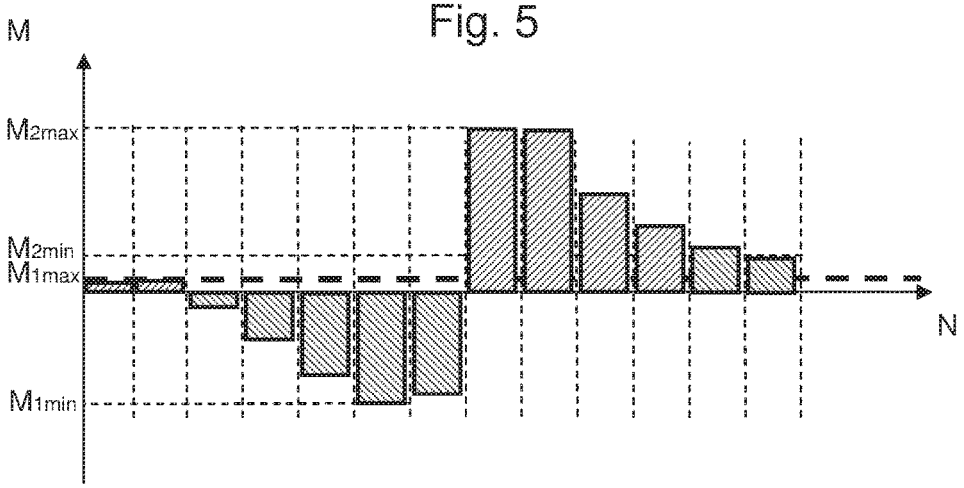
FIG. 5 is a torque diagram of the individual godets of the drawing line according to FIG. 2.
Figure 6:
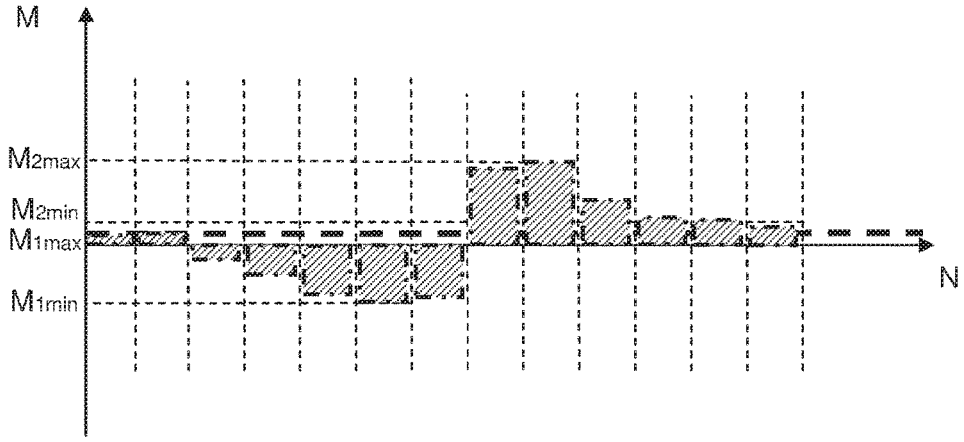
FIG. 6 is a torque diagram of the individual godets in a drawing line with two drawing units according to FIG. 2 with a second speed or drawing profile.

FIG. 4 shows a speed diagram with two different speeds V of a first and second drawing unit 1.1 and 1.2 driven by one motor 3.1 and 3.2 each, where $V_1$ is the speed (circumferential speed=rotational speed of godet times radius of godet surface; the circumferential speed corresponds to the speed of the tow 6; this description always talks of speed while the value of rotational godet speed results from the above relationship) of the godets 2 of the first drawing unit 1.1 and $V_2$ is the speed of the godets 2 of the second drawing unit 1.2 (see also FIG. 1 and FIG. 2). The continuous line shows a higher drawing ratio, the dashed line a lower one. The course of the torques M exerted on the godets 2 by the tow 6 (starting from an average torque) is illustrated in the diagrams of FIGS. 5 and 6. The bars shown in continuous outlines in FIG. 5 correspond to a higher drawing ratio and the bars shown in dashed outlines in FIG. 6 to a lower one—see also the speeds represented as continuous and dashed lines in FIG. 4.

FIG. 4 makes it clear that the first drawing unit 1.1 is driven more slowly than the second drawing unit 1.2 so that the tows 6 schematically illustrated in FIG. 1 are drawn. As a result, the total torque taken up by the second drawing unit 1.2 is higher than the torque taken up by the first drawing unit 1.1. The difference in torques between the first and second drawing units 1.1 and 1.2 represents the frictional heat or drawing force, respectively, which is required for drawing the tow or filaments 6. Drawing the molecules of a filament requires a certain drawing force. By drawing the molecule of a filament a certain friction is generated between the individual molecules so that the filaments or the tow can heat up to about 100° C.

FIG. 5 shows the distribution of torques M among the altogether fourteen godets 2 in the two drawing units 1.1, 1.2 (see FIG. 4—continuous line). FIG. 6 shows the distribution of torques for a smaller drawing ratio (FIG. 4—dashed line). The maximum and minimum torques are identified by $M_{1mx}$, $M_{2max}$, $M_{2min}$ etc.

As suggested in FIG. 1, the last drive roller of the last godet 2 in the first drawing unit 1.1 and the first drive roller of the first godet 2 in the second drawing unit 1.2 are wrapped by the tow 6 only by 90° so that at these points not the full torque is transferred. As a result a higher slip occurs at these points. Since the tow 6 can slide over the surface of the godet 2 at these points, the godet is more strongly worn at and does not transfer the full torque either. The drawing forces on the last godet 2 of the first drawing unit 1.1 and on the first godet 2 of the second drawing unit 1.2 mostly are therefore somewhat lower than those on the neighboring godets 2. It is an advantage here that the surfaces of these godets are chromium-plated or have a ceramic coating in order to produce better adhesion.

When calculating the driving force based on the example of FIGS. 1 and 2 (state of the art), the selection of a drive motor is determined by the maximum torque $M_{2max}$ (FIG. 5 or FIG. 6), i.e. the driving unit is oversized. Consequently, larger gears are required so that modifications of customary lines according to FIG. 1 are costly and time-consuming.

With a driving unit according to FIG. 3, the energy consumption can be reduced. Here the drives are laid out individually for the maximum demand of the respective godets 2 by grading the specific drive speeds and thus make available for each individual godet 2 a specific ideal driving torque. A total torque $M_d$=M/N must be made available for this purpose, $M_d$ being the average torque, M the motor torque and N the number of drive for driving a single godet 2.

The individual motors 31.1.-32.14 are designed for the specific maximum torque of a godet 2. With the use of a frequency converter, the required speeds $V_1$ and $V_2$ can be monitored and adjusted in such a way that the desired drawing effect is achieved for the tow 6. For this purpose, a torque control system is used for driving all motors 31.1-32.14. The previously established $M_d$ is the setpoint torque for driving all motors. See also FIGS. 7 and 8.

Figure 7:
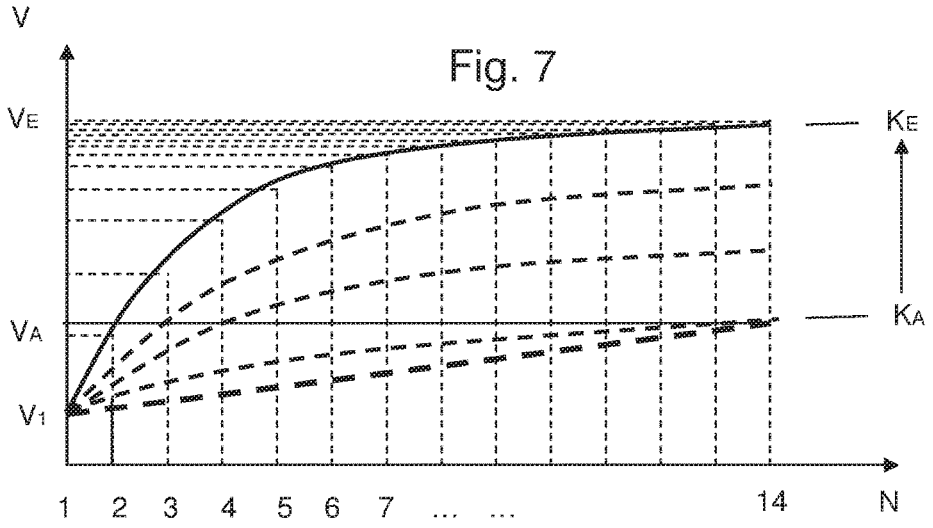
FIG. 7 is a diagram with rising speed curve for adapted torques of a godet arrangement in line with FIG. 3.

$V_1$ is the initial speed which is gradually increased according to the desired drawing effect on the tow 6 to the subsequent values according to FIG. 7 so that the desired drawing effect is achieved. If the actual torque differs from the setpoint torque, the current speed is adapted to the setpoint speed by iteration using the control system.

As shown by FIG. 7, the tow 6 can be easily drawn at the beginning as it still can be strongly elongated. The more the tow 6 has been elongated, the higher the required torque for driving the respective motor 3, as the drawing forces increase with increasing elongation. The speed increments for godets one to seven are much higher than the speed increments of the subsequent godets.

The torques of the godets 2 are sampled several times per time unit so that the drive speed of the individual godets 2 can be adapted. The signal sampled by the control system represents the controlled variable used to determine the required drive speed and thus to determine the required torque of the godets 2.

By continually monitoring the torque and adjusting the required torque, the drive system after a short run-in time is continuously optimized for the required conditions. As a consequence, only the amount of drive energy required for driving each individual motor 3 is made available. Oversizing of the drive unit can be avoided by the control system in line with the invention using the control curve according to FIG. 7.

Figure 8:
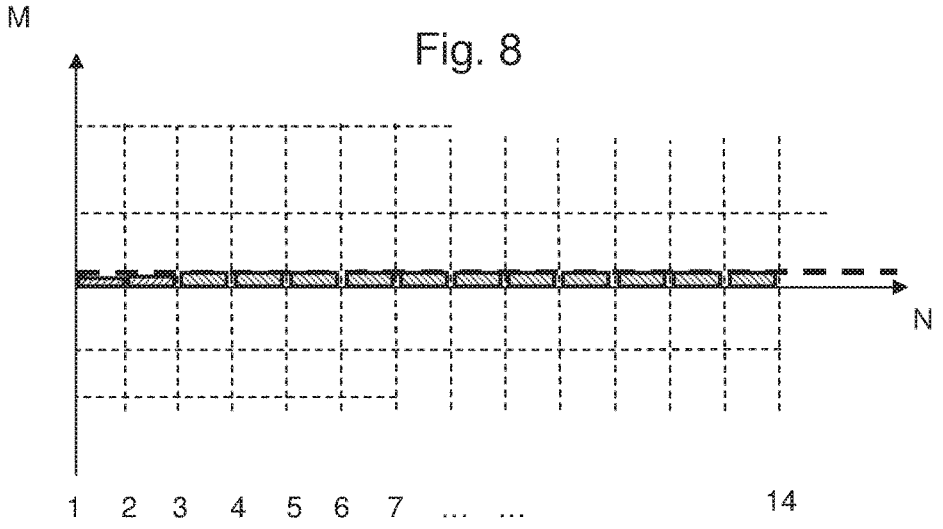
FIG. 8 is a torque diagram for the individual godets of an adjusted machine in line with FIG. 3.

The drive of a drawing line during the optimization stage is effected by the following process steps:

a) The first godet 2 (FIGS. 7—N=1) is driven at a pre-determined speed $V_1$ (which is not changed by the control system, thus remains constant and is selected to match the speed, for example, at which the tow 6 arriving from the spinning plant is supplied). Another given speed is the operating speed $V_2$ of the last godet (according to FIG. 3—driven by motor 32.14). This determines the drawing ratio. This ratio also depends on how the drawn tow 6 shall be further processed.

b) The line is started according to the dashed line (FIG. 7) with a freely selectable starting draw ratio with the speed increase being distributed either in a linear manner (or freely selectable) among the individual godets. This means that the godets (FIGS. 7—N=2, 3, 4 . . . . ) following the first godet (FIG. 7—left end, N=1) are driven at a speed increased in a linear manner (or by a freely selectable function). This means that the initial speed distribution is determined, which is identified by $K_A$ in FIG. 7. The speed of the last godet (FIGS. 7—N=14) is preferably smaller than the intended final speed $V_2$. In FIG. 7, $V_A$ is the speed of the initial drawing stage, so that in this case $V_A<V_E$.

c) The tow 6 is placed on the godets and the torque optimization process is started.

d) The drives 31.1, 31.2 . . . 32.14 of the individual godets 2 are continually monitored by means of the control system and the actual torques compared to the specified setpoint torques. The speeds of the individual godets are controlled accordingly. Based on an initial speed distribution (FIG. 7—curve $K_A$), the drives 31.2 . . . 32.14 of the godets are accelerated—resulting during the individual iterations in the speed distributions suggested by the dashed lines above the starting curve $K_A$ in FIG. 7. This optimization process continues until the torques of the individual drives 31.1, 31.2 . . . 32.14 meet the specified setpoints and the torque of the last godet (FIGS. 7—N=14) reaches the specified final speed $V_2$ which defines the draw ratio. The torques of the individual drives 31.1, 31.2 . . . 32.14 are preferably controlled until the situation represented in FIG. 8 is given, namely that the same torque is given throughout.

e) The speeds of the godets of the final curve $K_E$ thus obtained are saved and can be used as setpoint values during the next starting procedure to accelerate the start-up process.

As mentioned above, it is possible to drive the last godet (N=14) right from the beginning at the speed $V_2$ (required speed) defining the draw ratio ($V_A=V_E$). Preferably, however, the starting torque is selected according to the formula $V_A<V_E$ so that unfavorable situations during the optimization stage can absolutely be avoided.

Speed changes ($V_1$ and/or $V_2$) during operation of the drawing line in conformity with the invention are carried out analogously. Here also the speeds of the individual godets are optimized in such a way that the specified setpoint torques are reached.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for driving a drawing line or drawing unit for drawing of tows having polymer filaments comprising a plurality of driven drawing rollers for drawing the tows and a plurality of separately controllable drive units, one of the plurality of separately controllable drive units being operably connected to each of the driven drawing rollers for individually controlling the torque on each drawing roller, said method comprising:

comparing a measured torque on a given drawing roller of the plurality of drawing rollers to a setpoint torque for the given drawing roller; and controlling the drive unit controlling the given drawing roller to bring the measured torque closer to the setpoint torque, wherein said individually controlling the torque on each drawing roller is done automatically through gradual approximation based on a setpoint torque curve or a setpoint torque characteristic, wherein each drawing roller is controlled to run at a specified rotational speed based on a current control, wherein said individually controlling the torque is continued until the torque on each drawing roller meets the setpoint torque and each drawing roller reaches the specified rotational speed, wherein torques of the separately controllable drive units are controlled until a same torque is given throughout, and wherein a first of the plurality of driven drawing rollers is driven at a fixed rotational speed and the rotational speed of the other of the plurality of driven drawing rollers increases until reaching the specified rotational speed.

2. The method according to claim 1, wherein each drawing roller is assigned a speed sensor.

3. The method according to claim 1, wherein the separately controllable drive unit is an asynchronous motor having an assigned frequency converter.

4. The method of claim 1, further comprising:

registering an actual torque of a given one of the plurality of drawing rollers;

comparing the actual torque to a given setpoint torque; and controlling the given drawing roller based on a relationship between the actual torque and the setpoint torque.

5. The method of claim 1, further comprising shutting down one of the drawing rollers if a speed or torque of the one of the drawing rollers exceeds a given value.

6. A method for driving a drawing line or drawing unit for drawing of tows having polymer filaments comprising a plurality of driven drawing rollers for drawing the tows and a plurality of separately controllable drive units, one of the plurality of separately controllable drive units being operably connected to each of the driven drawing rollers for individually controlling the torque on each drawing roller, said method comprising:

comparing a measured torque on a given drawing roller of the plurality of drawing rollers to a setpoint torque for the given drawing roller; and controlling the drive unit controlling the given drawing roller to bring the measured torque closer to the setpoint torque, wherein said individually controlling the torque on each drawing roller is done automatically through gradual approximation based on a setpoint torque curve or a setpoint torque characteristic, wherein each drawing roller is controlled to run at a specified rotational speed based on a current control, wherein said individually controlling the torque is continued until the torque on each drawing roller meets the setpoint torque and each drawing roller reaches the specified rotational speed, and wherein torques of the separately controllable drive units are controlled until a same torque is given throughout, the method further comprising:

driving a first one of the plurality of drawing rollers at a previously determined speed;

determining a speed of a subsequent one of the plurality of drawing rollers and a draw ratio of the first one of the plurality of rollers and the subsequent one of the plurality of rollers;

starting the drawing line at a free selectable starting draw ratio;

for a set of intermediate drawing rollers between the first one of the plurality of drawing rollers and the subsequent one of the plurality of drawing rollers, setting the speed of each intermediate drawing roller to be between the previously determined speed and the speed of the subsequent one of the plurality of drawing rollers;

placing a tow on the plurality of drawing rollers and initiating a torque optimization process by monitoring and adjusting the torque on each of the intermediate drawing rollers so that the torque on each of the intermediate drawing rollers approaches a setpoint torque for said each intermediate drawing roller; and accelerating the rollers of the set of drawing rollers to a final speed.

7. The method of claim 6, further comprising:

recording the final speeds of the intermediate drawing rollers;

registering the final speeds in a setpoint curve; and using the registered final speeds for a subsequent starting process.

8. A method for driving a drawing line or drawing unit for drawing of tows having polymer filaments comprising a plurality of driven drawing rollers for drawing the tows and a plurality of separately controllable drive units, one of the plurality of separately controllable drive units being operably connected to each of the driven drawing rollers for individually controlling a torque on each drawing roller, said method comprising:

comparing a measured torque on a given drawing roller to a setpoint torque for the given drawing roller; and controlling the drive unit operably connected to the given drawing roller so that the measured torque on the given drawing roller of the plurality of drawing rollers approaches the setpoint torque for the given drawing roller, wherein said individually controlling the torque on each drawing roller is done automatically through gradual approximation based on a setpoint torque curve or a setpoint torque characteristic and wherein said individually controlling the torque is continued until the torque on each drawing roller meets the setpoint torque, wherein torques of the separately controllable drive units are controlled until a same torque is given throughout, and wherein a first of the plurality of driven drawing rollers is driven at a fixed rotational speed and the rotational speed of the other of the plurality of driven drawing rollers increases until reaching a specified rotational speed.

9. The method according to claim 8, wherein the plurality of separately controllable drive units are operable to drive the plurality of driven rollers at different speeds.

10. The method according to claim 8, wherein the plurality of driven rollers are driven at different speeds.

11. The method according to claim 8, wherein the plurality of separately controllable drive units comprise a frequency converter configured to set a rotational speed of the plurality of driven drawing rollers.

12. The method according to claim 8, wherein the plurality of separately controllable drive units comprise a field-oriented converter configured to set a rotational speed of the plurality of driven drawing rollers.

13. The method according to claim 8, wherein the first of the plurality of driven drawing rollers and a last of the plurality of driven drawing rollers are driven at the fixed rotational speed to determine a drawing ratio and the rotational speed increase is distributed among the other of the plurality of driven drawing rollers in a linear manner or a freely selectable manner until reaching the specified rotational speed.

14. The method according to claim 8, wherein final speeds of the plurality of drawing rollers are recorded and registered in the setpoint curve for use in a subsequent starting process.

15. The method according to claim 1, wherein the first of the plurality of driven drawing rollers and a last of the plurality of driven drawing rollers are driven at the fixed rotational speed and the rotational speed of the other of the plurality of driven drawing rollers increases until reaching the specified rotational speed.

* * * * *